United States Patent [19]

Skinner et al.

[11] 4,246,872

[45] Jan. 27, 1981

[54] HEAT EXCHANGER TUBE SUPPORT

[75] Inventors: David R. Skinner; Ralph S. Clemens, both of Georgetown; Robert A. Cerrone, Westford, all of Mass.

[73] Assignee: General Electric Company, Lynn, Mass.

[21] Appl. No.: 34,377

[22] Filed: Apr. 30, 1979

[51] Int. Cl.[3] ..... F22B 37/24

[52] U.S. Cl. ..... 122/510; 122/512; 165/67; 165/77; 165/162

[58] Field of Search ..... 122/510–512, 122/DIG. 13, DIG. 14, 7 B, 205, 235 C; 165/67, 77, 162

[56] References Cited

U.S. PATENT DOCUMENTS

| | | | |
|---|---|---|---|
| 1,757,343 | 5/1930 | Steinmuller | 122/510 |
| 1,977,247 | 10/1934 | Scott et al. | 122/510 |
| 2,873,098 | 2/1959 | Morgan | 122/512 |
| 3,760,774 | 9/1973 | Michel | 122/510 |
| 3,896,874 | 7/1975 | Bongaards et al. | 122/510 |

FOREIGN PATENT DOCUMENTS

| | | | |
|---|---|---|---|
| 1207894 | 7/1958 | France | 122/510 |
| 638478 | 6/1950 | United Kingdom | 122/510 |
| 1409943 | 10/1975 | United Kingdom | 122/510 |

*Primary Examiner*—Henry C. Yuen

*Attorney, Agent, or Firm*—James W. Mitchell

[57] ABSTRACT

In a counterflow non-contact heat exchanger, tube bundles carry fluid back and forth across a hot gas path. As the fluid in the tubes flows vertically downward the temperature of the fluid rises. As the gas rises in the heat exchanger it loses heat due to the heat exchange process. This means that the temperature profile of a tube bundle will show a greater thermal expansion in the lower tubes. The present invention seeks to provide an efficient and improved support arrangement for heat exchanger tubes to accommodate this phenomenon by supplying a pivotally mounted tube support plate which will rotate and translate slightly from a substantially vertical plane to accommodate thermal expansion. Further, if there are multiple tube bundles, additional tube support plate sections will allow a tube support plate to articulate in sections to accommodate thermal movement.

3 Claims, 6 Drawing Figures

61
63
37

35
39
37
33
41
41
41
43
45

55
53
51
47
49
45

HEAT EXCHANGER TUBE SUPPORT

BACKGROUND OF THE INVENTION

This invention relates, in general, to large heat exchangers; and, in particular, to non-contact steam generators. Non-contact steam generators for purposes of the present invention may be defined as an apparatus for producing steam by passing hot gases through an enclosed duct so as to heat water/steam in fluid carrying tube bundles disposed across the duct. The hot gases may be produced by firing burners at the base of the steam generator or the hot gas may be the hot exhaust gas of a gas turbine as is found in a power plant arrangement known as a combined cycle power plant. One particular form of a steam generator is a heat recovery steam generator which may be formed of several sections constructed in modular fashion. Such sections are well known in the art as a preheater (low pressure economizer), economizer (high pressure economizer), evaporator and superheater. The economizer, evaporator and superheater may all be in fluid communication with a steam drum located outside the hot exhaust path. One such configuration is shown in U.S. Pat. No. 3,934,553 to Freeman et al and assigned to the assignee of the present invention. The aforementioned sections have all been mentioned in descending order with respect to the manner in which they are usually assembled in the steam generator. As the hot gas rises in the steam generator flow path, the temperature of the gas decreases. As the water descends through the steam generator tubes, the water/steam temperature rises; i.e., the two heat exchange mediums flow counter with respect to one another.

In the prior art, the heat exchange tubes were mounted in fixed tube support plates such that the tubes were allowed to expand thermally by sliding through the holes in the tube support. As will be later substantiated, this arrangement does not produce optimum results in the instance of unequal tube expansion which is not strictly in the axial direction, and may lead to a permanent warp in a tube bundle causing unsatisfactory performance and potential early failure of the tube bundle.

SUMMARY OF THE INVENTION

The present invention improves upon the prior art by providing a plurality of tube support plates which are pivotally mounted within the hot gas path. As previously described, the lower tubes in a particular bundle are usually at a higher temperature than the upper tubes of that same tube bundle since the tube liquid is heated as it travels through the tube. This results in unequal thermal expansion of the tube bundle with the lower tube expanding further in the horizontal direction than the upper tube. To provide a non-binding support, the tube support plates are hingedly or pivotally connected to the framework of a hot gas duct so that they may rotate and translate slightly in the direction of tube expansion. Likewise, if there are separate upper and lower tube bundles then a two section support plate is used with the lower section hinged to the upper section and the entire section pivotally supported in the hot gas duct.

One object of the present invention is to provide an articulate tube support for a non-contact heat exchange tube bundle.

Another object of the present invention is to eliminate tube support-tube bundle binding under conditions of thermal expansion.

The novel features believed characteristic of the present invention are set forth in the appended claims. The invention itself, however, together with further objects and advantages thereof may best be understood with reference to the following description taken in connection with the drawings.

DETAILED DESCRIPTION OF THE INVENTION

Figure 1:
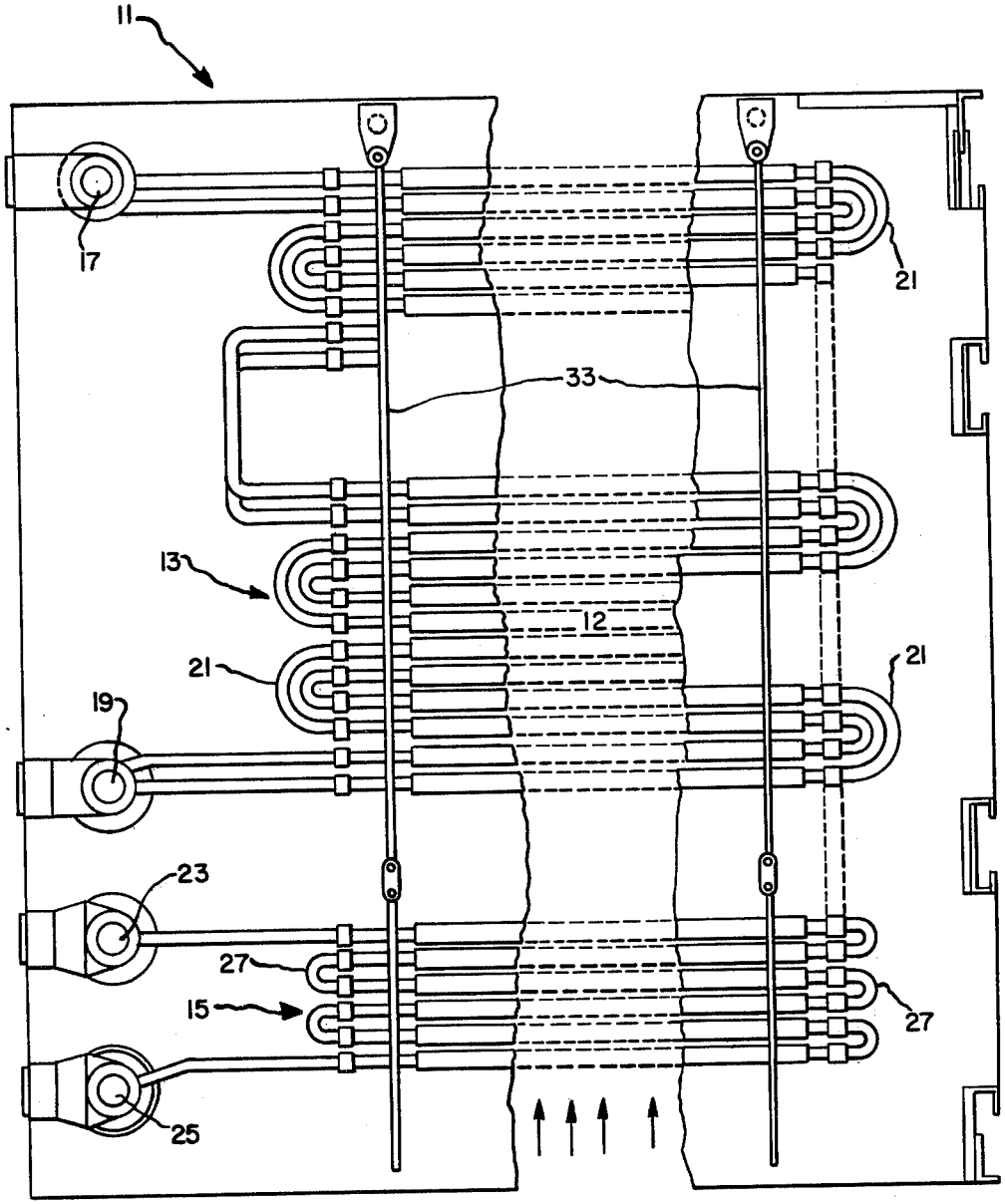
FIG. 1 is a cutaway elevation drawing of a steam generator duct showing the present invention in place.
Figure 3:
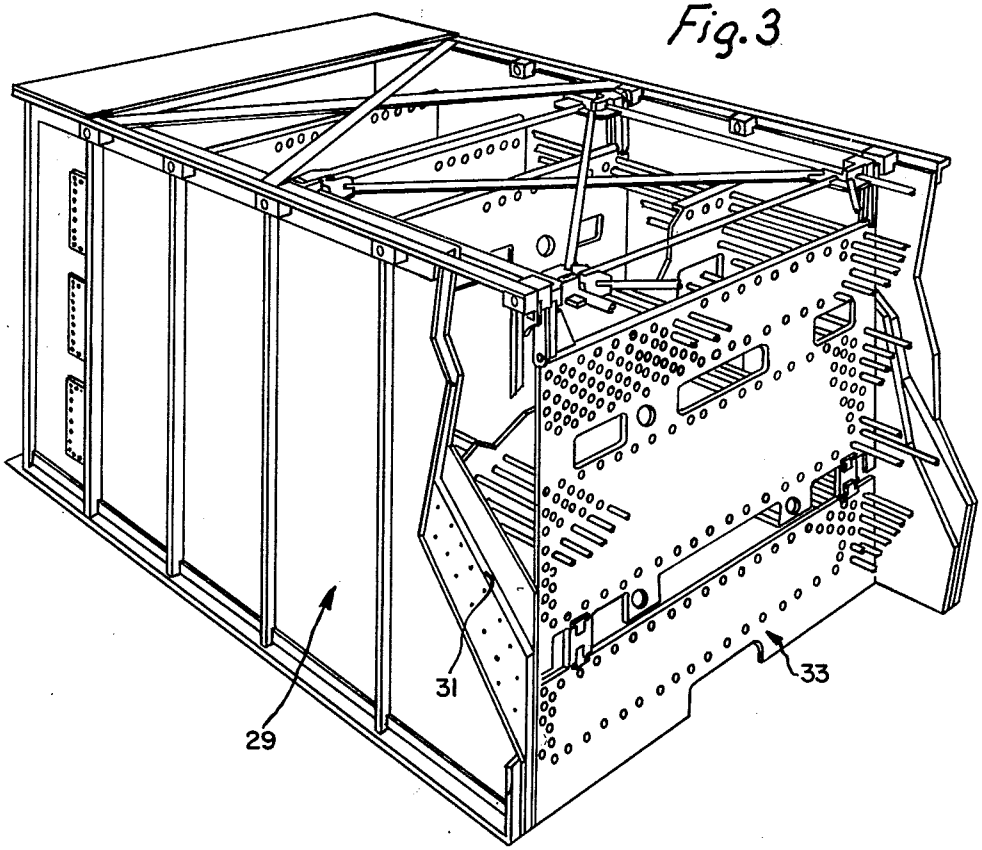
FIG. 3 is an isometric view showing the steam generator section in further detail.

FIG. 1 is a cutaway elevation drawing with mid-section removed of a heat exchange apparatus 11 which includes a hot gas flow path defined by a duct 12. The arrows entering the lower portion of the heat exchange apparatus indicate the flow direction and usual dispersal of hot gases through the heat exchange apparatus. Noting that this may be only one modular section of an entire steam generator more heat exchange tubes may be positioned above and below those illustrated in FIG. 1 thereby comprising other modular sections. Moreover, this modular section shown in FIG. 1, may be considered as one portion of an entire smokestack like structure.

For purposes of illustrating one particular application of a preferred embodiment of the present invention, the heat exchange apparatus 11 may be considered a part of a so-called heat recovery steam generator. As shown in U.S. Pat. No. 3,934,553 to Freeman et al the heat recovery steam generator accepts hot exhaust gases from a gas turbine and directs these gases in a heat exchange relationship with fluid which is contained in tube bundles located in the stack. Accordingly, the section shown would approximate a so-called low pressure and high pressure economizer section in descending order. The low pressure economizer or preheater comprises upper tube bundles 13 whereas the high pressure economizer comprises lower tube bundles 15. The low pressure economizer includes a tube inlet header 17 and a tube outlet header 19 whereas fluid flow through the tubes is reversed within the heat exchanger at "U" bends 21 from the inlet header to the outlet header.

Similarly, the high pressure economizer tubes include an inlet header 23 and an outlet header 25 at one end of the heat exchanger whereas fluid flow may be directed in a serpentine path which includes "U" bends 27 at either end of the heat exchange apparatus. The choice of configuration is illustrative and does not define limiting factors or parameters of the invention.

The invention is embodied in the apparatus for supporting the tube bundles. Referring to FIGS. 3, 4, 4A and 4B, the heat exchange apparatus 11 is further defined by walls 29 which may include thermal insulation 31 to prevent heat loss through the walls to the surrounding atmosphere. There are a number of tube support plates 33 spaced along the length of the heat exchange apparatus.

Figures 4, 4A, 4B:
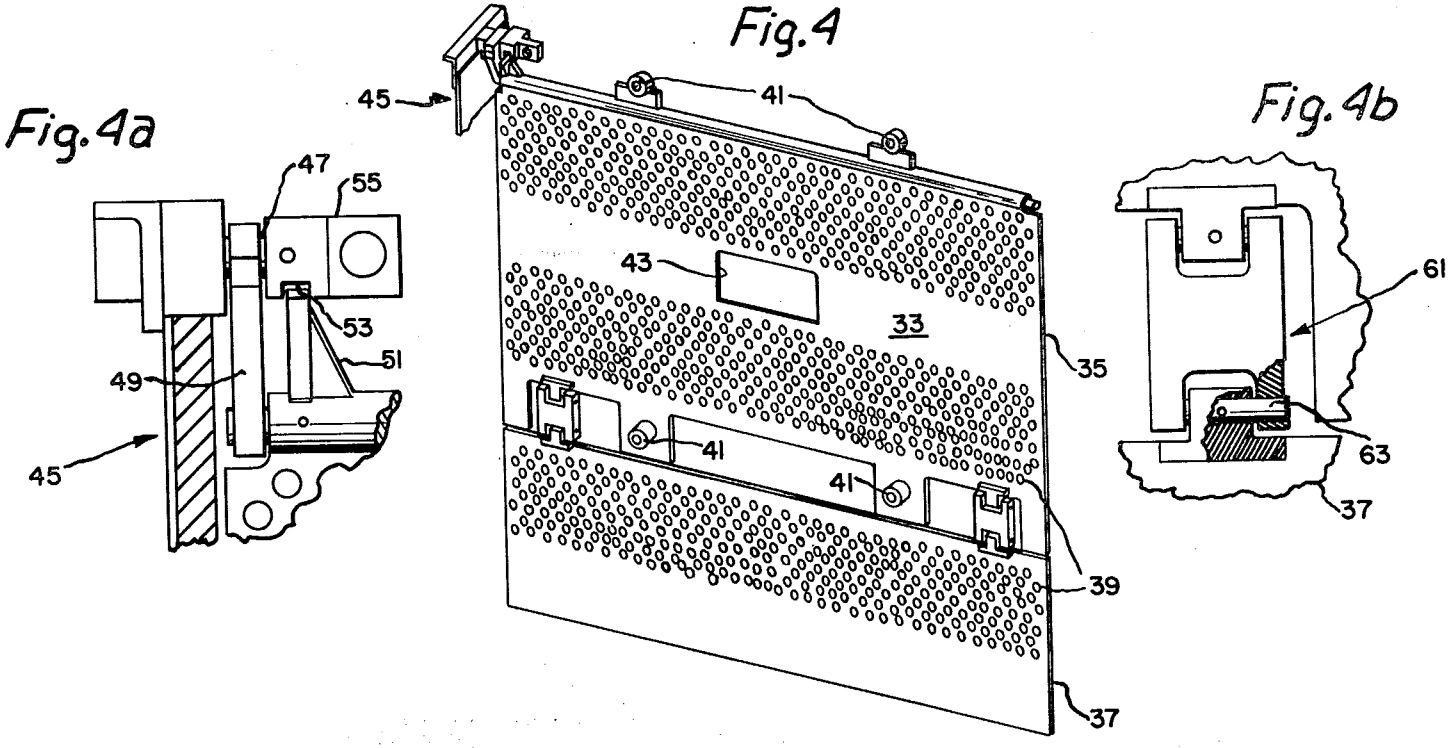
FIG. 4 is an isolated view of a tube support plate.
FIG. 4A is an enlarged view of an upper pivot support for a tube plate. p
FIG. 4B is an enlarged view of a hinge support for a lower plate section.

In FIG. 4, the tube support plate is shown in an isolated view. The tube support includes an upper tube support section 35 and a lower tube support section 37. Each tube support section includes tube accepting holes 39 formed therethrough in a regular and aligned configuration. Other aperatures such as soot blower holes 41 and maintenance access holes 43 are also present in the tube support. Each tube support is supported in a substantially vertical position in the heat exchange apparatus.

An upper pivotal support 45 on either side of the tube support plate is attached to the heat exchange apparatus opposite walls in a first pin connection as shown in FIG 4A. While the details of construction are not explicitly shown, the pin connection includes a first pin 47 which may be fastened into either wall by bolts. The pin may include a counter-bore at each end to accept the bolts (not shown). The pin supports depending linkage 49 which in turn supports a second pin extending horizontally outwardly from the top of the tube support at each end. Hence, the conclusion is that the linkage is free to pivot around the first pin and hence, the tube support plate may translate relative to the first pin and rotate about the second pin to accommodate tube expansion as will be shown in conjunction with FIG. 2.

The tube support plate also includes an upperwardly extending angle member 51 which intersects a cutout 53 formed in block 55 on the pin to prevent lateral movement of the tube support plate during transport.

Referring now to FIG. 4B, the lower tube support section 37 is hingedly attached to the upper tube support section 35. An "H" shaped hinge member 61 is held to fixtures on the upper and lower tube support sections by roller pins 63. This allows the lower tube support section to translate and rotate relative to the upper tube support section to accommodate differential thermal expansion and relative growth rates between two different tube bundles. Alternative to the "H" hinge, there are other equivalent connection arrangements which will give hinged movement.

Figure 2:
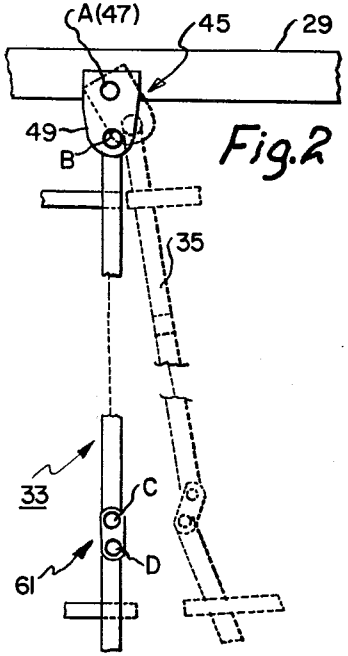
FIG. 2 is a schematic drawing of upper and lower tube support plate portions phantomed lines to show articulation through translation and rotation.

The operation of the invention will now be explained with reference to FIG. 2, an elevation side view of a tube support plate 33. As the tubes containing a water/steam mixture are subjected to hot gas, the tubes will expand in accordance with the temperature applied to the tube including the hot gas temperature and the steam water temperature. Referring back to FIG. 1, it is apparent that the gas temperature of the HRSG will decrease as the gas rises and transfers heat to the steam/water mixture in the tubes. Likewise as the steam/water mixture passes through the tubes the mixture temperature will increase. The tubes therefore will not only expand in the axial direction but also will be pulled in an upward direction assuming the description of the events given here. In any event, the present invention obviates tube to tube plate binding and warping by having the ability to translate and rotate to accommodate thermal changes and stresses.

Reviewing pivot support 45, pin A is fixed to the duct wall. Linkage 49 may rotate about pin A. Pin A corresponds to pin 47 in other drawings. Pin B rotates through an arc and in effect translates in the axial direction. The upper support plate 35 can translate in the axial direction and rotate about pin B. Likewise, hinge support 61 moves with the upper support plate section while allowing the lower support plate section the freedom to translate point C and rotate point D. While this invention may be advantageously used in the embodiment shown it should not be so limited nor should it be limited to a particular fluid or even to the spatial orientation shown.

While there is shown what is considered, at present, to be the preferred embodiment of the invention, it is, of course, understood that various other modifications may be made therein. Such modifications may include the use of at least one pivoted tube support plate or alternatively the use of two or more pivotally mounted tube support plates interconnected to one another. It is intended to claim all such modifications as fall within the true spirit and scope of the invention.

What is claimed is:

1. A heat recovery steam generator section having at least one duct defining a hot gas flow path, said heat recovery steam generator including a plurality of tubes traversing said duct for carrying fluid in a non-contact, counterflow heat exchange relation with said hot gas; and, means for supporting said tubes comprising:

a plurality of tube support plates mounted in said duct and having a plurality of aperatures in each tube support plate for receiving said fluid carrying tubes;

an upper tube support plate section attached at each upper end to opposite duct walls through a pivotal support means including a fixed first pin support, linkage rotatable about said fixed pin support and a second pin support carried by said linkage and rotatable therewith; and, a lower tube support plate section attached to the lower end of said upper tube support plate section through a hinge joint comprising a pin connection at each end of each hinge joint whereby the upper and lower tube support sections are free to rotate and translate with respect to one another and also with respect to said first fixed pin support.

2. In a heat exchange apparatus defining at least one gas flow path and having a plurality of fluid-carrying tubes disposed across the gas flow path, means are provided for supporting the fluid-carrying tubes, said means comprising:

a tube support plate having a plurality of tube-accepting apertures formed therethrough;

a pivot support for said tube support plate comprising a first pin support fixed to said heat exchange apparatus; linkage attached at one end to said first pin support and rotatable about said first pin support and having a second pin support attached to the other end of said linkage; said tube support plate rotatably attached at one end to said second pin support;

an additional tube support attached to said first tube support plate, said additional tube support plate including a plurality of tube-accepting apertures formed therethrough; and, a support hinge interconnecting the first and additional tube support plates, said support hinge being rotatable relative to said first and additional tube support plates.

3. In a heat exchange apparatus having at least one duct section defining a hot gas flow path, said heat exchange apparatus including a plurality of heat exchange tubes disposed across the duct for passing fluid through the tubes in a noncontact heat exchange relation with the hot gas; means for supporting heat exchange tubes in the hot gas duct comprising:

a first tube support plate section disposed across said duct and having a plurality of tube-accepting apertures formed therethrough;

a pivot support for said first tube support plate section comprising a first pin support fixed to said heat exchange apparatus; linkage attached to one end to said first pin support and rotatable about said first pin support and having a second pin support attached to the other end of said linkage; said tube support plate section rotatably attached at one end to said second pin support;

a second tube support plate section attached to said first tube support plate section; and, a hinge interconnecting the second tube support plate section with the first tube support plate section, said hinge being rotatable with respect to the first and second tube support plate sections.

* * * * *